US009523512B2

(12) United States Patent
Carlay, II

(10) Patent No.: US 9,523,512 B2
(45) Date of Patent: Dec. 20, 2016

(54) INSULATED DUCT WITH AIR JACKET AND METHOD OF USE

(71) Applicant: Ronald L. Carlay, II, Cookeville, TN (US)

(72) Inventor: Ronald L. Carlay, II, Cookeville, TN (US)

(73) Assignee: FLEXIBLE TECHNOLOGIES, INC., Abbeville, SC (US)

( * ) Notice: Subject to any disclaimer, the term of this patent is extended or adjusted under 35 U.S.C. 154(b) by 115 days.

(21) Appl. No.: 14/038,941

(22) Filed: Sep. 27, 2013

(65) Prior Publication Data

US 2015/0090360 A1 Apr. 2, 2015

(51) Int. Cl.
*F16L 9/18* (2006.01)
*F24F 13/02* (2006.01)

(52) U.S. Cl.
CPC ..... *F24F 13/0263* (2013.01); *Y10T 29/49826* (2015.01)

(58) Field of Classification Search
USPC ..... 138/109, 114, 148
See application file for complete search history.

(56) References Cited

U.S. PATENT DOCUMENTS 1,954,454 A * 4/1934 McFarland ..... F16J 15/14 123/193.3
2,572,062 A * 10/1951 Sexton ..... B29D 23/001 137/594
2,610,028 A * 9/1952 Smith ..... E21B 17/00 138/148
2,755,638 A 7/1956 Sevin
3,765,705 A * 10/1973 Tantam ..... F16L 59/16 138/114
4,151,830 A * 5/1979 Crombie ..... F24J 2/205 126/591
4,183,378 A * 1/1980 Decker ..... B64B 1/06 138/148
4,691,741 A * 9/1987 Affa ..... F16L 59/07 138/113
4,735,235 A * 4/1988 Anderson ..... F16L 59/16 138/109
4,990,143 A 2/1991 Sheridan
5,170,557 A * 12/1992 Rigsby ..... B21C 37/154 138/148
5,203,378 A * 4/1993 Williams ..... F16L 11/20 138/104
5,423,353 A * 6/1995 Sorensen ..... F16L 39/02 138/109

(Continued)

FOREIGN PATENT DOCUMENTS

GB 266177 2/1927
GB 341552 1/1931

(Continued)

*Primary Examiner* — James Hook
(74) *Attorney, Agent, or Firm* — Clark & Brody

(57) ABSTRACT

An insulated duct includes an inflatable jacket surround the duct. The jacket is inflated, preferably with air traveling in the duct, to create a static condition in the air space formed by the jacket to provide additional insulation for the duct. When the jacket is combined with additional insulation and low emissivity material, the R value of the duct can be increased in a more efficient manner from manufacturing and cost viewpoints.

15 Claims, 5 Drawing Sheets

(56) References Cited

U.S. PATENT DOCUMENTS 5,526,849 A 6/1996 Gray
5,600,752 A * 2/1997 Lopatinsky ..... A61M 16/1075 138/114
5,785,091 A 7/1998 Barker, II
6,000,420 A 12/1999 Nicholson et al.
6,158,477 A 12/2000 Waters
6,216,745 B1 * 4/2001 Augustynowicz .... F16L 59/065 138/114
6,282,834 B1 9/2001 Mossey
6,527,013 B2 3/2003 Somerville et al.
6,565,430 B2 * 5/2003 Gebke ..... F16L 11/02 454/296
6,926,040 B1 * 8/2005 Prescott ..... F16L 59/143 138/113
7,025,580 B2 * 4/2006 Heagy ..... B29C 63/34 138/108
7,442,121 B2 * 10/2008 Cassidy ..... F24F 13/0218 138/113
7,490,632 B2 * 2/2009 Grebe ..... F02M 35/10137 138/114
7,621,239 B2 11/2009 Rice
7,624,788 B2 * 12/2009 Brown ..... F28F 21/063 138/112
2002/0079010 A1 * 6/2002 Marchal ..... F16L 9/06 138/121
2004/0069362 A1 * 4/2004 Lessard ..... E04F 17/04 138/149
2005/0155663 A1 * 7/2005 Dhellemmes ..... F16L 59/029 138/149
2006/0000515 A1 * 1/2006 Huffman ..... F16L 11/133 138/114
2007/0079884 A1 * 4/2007 Tomerlin ..... F16L 11/081 138/112
2007/0131299 A1 6/2007 Kornbleet
2009/0133347 A1 5/2009 Wadsworth
2010/0282353 A1 * 11/2010 Baylot ..... F16L 9/18 138/114

FOREIGN PATENT DOCUMENTS

GB 931011 7/1963
GB 949567 2/1964
GB 1024954 4/1966

* cited by examiner

INSULATED DUCT WITH AIR JACKET AND METHOD OF USE

FIELD OF THE INVENTION

The present invention is directed to an insulated duct, and in particular, to an insulated duct that includes an air jacket that surrounds the duct to increase its insulating capability, wherein the air jacket uses air traveling in the duct itself to create an insulating space.

BACKGROUND ART

The construction of factory-made flexible HVAC ducts is well known in the industry. These types of ducts usually comprise a helical-supported duct liner (sometimes referred to as the core or inner core) covered by a layer of fiberglass insulation, which is, in turn, covered by a scrim-reinforced vapor barrier. Scrim is a material composed of geometrically-patterned cords that adds strength to a laminate construction when made a part thereof. U.S. Pat. Nos. 6,158,477 and 5,785,091 show typical constructions of factory made ducts. U.S. Pat. No. 5,785,091 teaches that the duct liner and vapor barrier can be manufactured from polymer tapes, particularly polyester. U.S. Pat. No. 5,526,849 discloses a plastic helix in combination with a metal helix and U.S. Pat. No. 4,990,143 discloses a polyester helix. United States Patent Publication No. 2007/0131299 discloses a polyester scrim used in a vapor barrier.

In the prior art, factory-made flexible HVAC ducts are typically constructed of three main components; a duct liner for conveying air, a layer of insulation for preventing energy loss through the duct wall, and a vapor barrier for holding the fiberglass around the liner while protecting the fiberglass from moisture. The duct liner is commonly constructed of a steel wire sandwiched between layers of polyester (PET) film. Other plastics and coated fabrics are also used to construct the wall of the duct liner. United States Published Patent Application No. 2010, 0186846 to Carlay et al. is another example of flexible duct and it is incorporated in its entirety herein.

In the HVAC industry, ductwork is often times specified by building codes to have a certain R value for a particular application. For example, if the ductwork is to run in an unconditioned space, the R value must be at least 6.0. The most common specified North American flexible duct fiberglass R-values are R4.2, R6.0 and R8.0 and each may be purchased pre-certified from fiberglass manufacturers. Obviously, the cost of the ductwork increases from one that has an R6.0 value to an R8.0 value due to the need to provide additional insulation, which is generally fiberglass insulation.

However, there is always a need to provide improved duct designs in the HVAC industry and other areas where air or fluid handling is necessary. The present invention responds to this need by providing an improved insulated duct.

SUMMARY OF THE INVENTION

It is the first object of the invention to provide an improved insulated duct.

It is another object of the invention to provide an improved insulated duct that can provide additional R value insulation without the need to use additional insulating materials and therefore, be made more economically.

A further object of the invention is a method of using fluid, e.g., air, flowing in ductwork to provide additional insulating properties to the duct.

Another object of the invention is a method of using the duct when handling a fluid like air to provide enhanced insulating characteristics. Other objects and advantages will become apparent as a description of the invention proceeds.

In satisfaction of the foregoing objects and advantages of the invention, the invention is an improvement in insulated ducting, particularly, flexible HVAC ducts.

One embodiment of the invention is an insulated duct, preferably sized for HVAC use comprising a duct segment having a duct wall, an axial length, and a peripheral length that forms a channel for fluid to flow therethrough. An inflatable jacket surrounds at least a portion of the axial and peripheral lengths of the duct wall, with the inflatable jacket comprising at least one membrane, opposite ends of the membrane sealed to form an inflatable space. For at least a portion of the axial and peripheral lengths of the duct wall surrounded by the inflatable jacket, the inflatable space has at least one opening formed to provide communication between either the inflatable space and the channel or the inflatable space and a source of fluid other than from the channel, wherein fluid from the channel or the source of fluid other than the channel inflates the inflatable space to form a static pressure condition and creates an insulating layer for the duct segment. While any fluid can be passed through the duct, a preferred fluid is air and more preferably, conditioned air as would be used in an HVAC duct system. Air is used as an exemplary fluid in the description but the inventive duct and its use are not limited to just applications using air.

The inflatable jacket can be used in combination with another insulating layer such as fiberglass or the like. In one mode, the insulating layer can be disposed between the inflatable jacket and the duct wall, with the at least one opening extending through the insulation layer to provide communication between the channel and the inflatable space. Alternatively, the insulating layer could surround the inflatable jacket.

To further enhance the insulating value of the duct, insulating jacket can include at least one or opposing low emissivity (low-E) materials to provide increased thermal resistance.

To caution against overpressurizing of the inflatable jacket, the jacket can include a pressure relief value. In addition, to help maintain the static pressure condition in the inflatable space, the at least one opening in communication with the inflatable air space can include a check valve.

To maintain the seal of the inflatable jacket, conventional fastening/sealing means likes clamps, tape, adhesive, or the like or combinations thereof can be used. These fastening/sealing techniques can also be used to secure additional insulating layers to the duct.

The inflatable jacket can be used in any number of configurations with a duct. One jacket can be used in combination with a number of ducts linked together. Alternatively, one jacket can be used for every duct segment.

When using a source of fluid other than that flowing through the channel of the duct, a separate line for the fluid is provided, with the line providing communication to the inflatable space of the inflatable jacket and the source of fluid. The separate line could be connected to the air handler providing fluid flow for the duct system or a second air handler, which would not be the one that provides fluid to the duct system.

Permeability of the jacket wall materials and leakage at joints/connections makes permanent inflation of the jacket impractical. Although the materials and joints/connections do not produce any measurable loss during active inflation, the permeability and leakage will not allow the jacket to maintain its pressurization over the life of the installation of the duct. Therefore, a static pressure created by the air in the duct is necessary to repressurize or maintain pressure in the inflatable jacket. The air handler blower of an HVAC system is the best and most economical source of air to create the static pressure necessary to keep the jacket inflated.

A controller can also be employed when using a separate line to supply the fluid for inflation, with the controller ensuring that the desired static pressure condition in the inflatable space is maintained.

While the thickness of the inflatable space can vary depending on the particular duct configuration, use of other insulating materials, etc., a typical range would be between about 0.25 to 0.75 inches.

The inflatable jacket can be used on any type of duct, rigid or flexible, scrim-containing or not, cylindrical or rectangular or square in cross section and the like.

The membrane of the inflatable jacket can be any material that will maintain the desired static pressure condition in the space. One membrane may only be needed if the duct wall forms the other side of the inflatable space. When the inflatable jacket is spaced from the duct wall, the inflatable space would be formed by opposing membranes.

The invention also entails a method of providing conditioned fluid like air through an insulted duct segment in a duct system, wherein the inventive insulated duct is employed in the duct system.

The invention also provides the ability to efficiently and cost effectively increase the insulating value of a duct using conditioned fluid traveling through the duct. This is accomplished by providing a duct having a predetermined R insulation value and adding the inflatable jacket to the duct, wherein the inflatable jacket uses the conditioned fluid passing through the duct to inflate the jacket and maintain its inflation by the static pressure within the duct, the inflatable jacket adding insulation value to the duct. The low-E material can be included with the inflatable jacket to further increase the R value of the modified duct. Thus, it is possible to take a duct that would typically have an R-6 value and increase the R value to R-8 using the inflatable jacket and low-E materials.

BRIEF DESCRIPTION OF THE DRAWINGS

Reference is now made to the drawings of the invention wherein.

DESCRIPTION OF THE PREFERRED EMBODIMENTS

Figure 1:
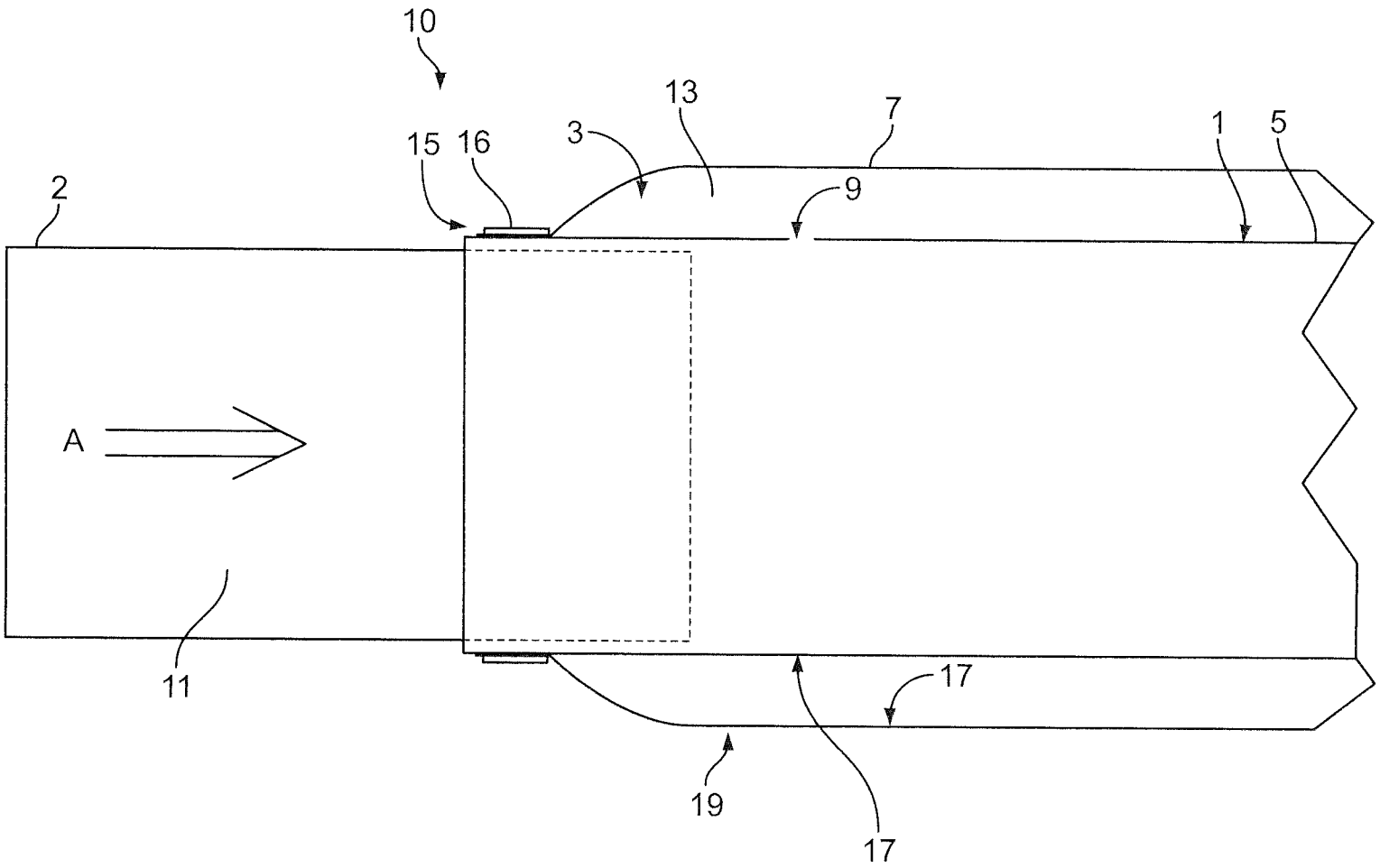
FIG. 1 is a schematic view of a first embodiment of an insulating duct of the invention.

The invention provides an improved duct for handling a fluid like conditioned air. The improvement derives from the creation of an air jacket that forms one or more of the layers of the duct. The air jacket is designed to provide an insulating effect, and possibly remove or lessen the amount of other insulators like fiberglass, which present safety and environmental problems.

The air jacket is designed so that air in the jacket is in a static state to maximize insulating properties. In order to achieve this static state, the gap or thickness of the air space in the air jacket should be controlled so that currents are not created, which would impair the insulating effect of the air jacket. While the thickness of the air space can vary depending on the diameter of the duct and its construction, a preferred range of the thickness is between about 0.25 to 0.75 inches, with a target of around 0.5 inch, which is similar to the gap employed in multiple pane window construction.

The insulating effect of the air jacket is achieved in the following manner. In one mode, air in the channel of the duct is used and in another mode, air from a source separate from the air in the duct channel is used. In either case, the air supplied to the duct inflates and pressurizes the air jacket to create the static pressure condition therein. When using the air in the duct channel itself, the duct channel has a static pressure, which provides the pressure to keep the jacket inflated once it initially fills with air. Once the jacket is inflated, the static pressure condition in the inflatable jacket matches that of the static pressure in the duct by virtue of the fact that the jacket is in communication with the channel of the duct. Once the flow of fluid in the channel is stopped, the jacket would deflate and then re-inflate once the air in the duct channel would start to flow again, thus reaching the static pressure condition in the inflatable jacket of essentially no currents to achieve the desired insulating effect.

The air jacket could be deployed by itself or in conjunction with at least one layer of insulation. The ductwork preferably used with the invention is that which is used in heating, ventilating and air conditioning (HVAC) applications and for these applications, the insulation is usually fiberglass. However, any known insulation can be employed in combination with the air jacket in duct construction, if insulation is used.

The duct using the air jacket can be any type of duct, rigid, or flexible, and with different cross sectional shapes, rectangular, circular, etc. For Class 1 (National Fire Protection Association) flexible ducts, the duct material would typically be that which would provide flame resistance at a minimum to pass the Flame Penetration test method in UL 181.

The source of the air or other fluid to pressurize the air space of the jacket can come from any source. A preferred source is air supplied by the air handler of an HVAC system. If the duct is on the positive pressure side of the system, the air flowing through a channel formed by the duct can be employed to inflate the air jacket, wherein the static pressure in the duct maintains the inflated state of the jacket. This can be done by providing one or more openings in the inner wall of the duct that would communicate with the air space of the air jacket. If the air jacket is not adjacent the duct inner wall, a conduit or the like can be used to provide communication between the channel formed by the duct and the air space of the air jacket.

If the duct is on the negative pressure or return side of the HVAC system, the air jacket could be inflated using a separate line receiving air from the air handler, i.e., the supply side of the air handler. This separate line could be connected directly to the air jacket if the air jacket is on the exterior of the duct or be used in connection with a conduit or the like if the air jacket is not on the exterior of the duct.

The separate line embodiment from an air/fluid source could also be employed to inflate the air jacket and keep it inflated using the duct static pressure if the duct is on the positive pressure side of the HVAC system and this would replace the use of the air flowing through the duct/duct static pressure for air jacket inflation.

Whether the air jacket is inflated by the separate line or direct communication with the duct channel, air flow into the air jacket is such that it inflates the air jacket to form its insulating and static pressure condition air space.

In the embodiment where the air flowing in the duct/duct static pressure is used to inflate the air jacket and maintain its inflation, the air jacket would be pressurized via one or more openings in the duct inner wall in order to keep the air jacket conditions static. It is preferred to have one opening to minimize the currents in the air space of the air jacket since more than one opening into the air jacket can increase the chance of airflow through the air jacket, i.e., currents in the air space. However, more than one opening could be used if the openings would be arranged to minimize the possibility of currents in the air jacket, and this is explained below.

Having a stagnant or static air condition within the air jacket minimizes heat transfer due to natural convection and minimizes degradation of surface film resistances to heat transfer. The size of the opening providing communication between the air source and the air space of the air jacket should be large enough to pressurize the air jacket as early in the blower-on cycle as possible, but not so large as to create currents within the air jacket. The earlier in the blower-on cycle that the jacket inflates, the sooner the full thermal resistance is provided. Laboratory tests were conducted to determine optimum opening sizes to pressurize the air jacket without creating unwanted currents. These tests suggest that pressurizing an air jacket using the static pressure within a 6 inch diameter duct wherein the air jacket has a 0.5 inch air space thickness and the inner wall of the duct has a 0.5 inch opening creates measurable flow in the air jacket only during pressurization. For a ten foot long duct, complete pressurization occurs within the first minute of the blower run cycle (even at low static pressures, e.g., 0.05" $H_2O$). Once pressurized, no flow was measured in the properly-sealed air jacket.

The air jacket can be made with any known materials that would hold the pressure created by the air source to inflate the jacket. In HVAC system ductwork, a number of different types of films or membranes are used that have low-permeability characteristics. Examples of these include polyethylene terephthalate (PET) vapor barriers, polyethylene (PE) film, polypropylene (PP) film, and laminates of various polymer films. These are just examples of the types of membranes that could be used to form the air jacket. One membrane could be used in connection with the duct wall to form the jacket or a pair of membranes could be used when the air jacket would be spaced from the duct inner wall. Both 1.5 mil blown-extruded PE film and PET vapor barrier have been successfully tested to form the membrane of the air jacket.

Depending on the particular duct construction, the duct may have other membranes as well. For example, a duct having an air jacket surrounded by an insulation layer may use a membrane as a vapor barrier on the outer surface of the duct. Flexible ducts using scrims would also have membranes as part of the scrim-containing duct wall construction.

The air jacket can be employed in the duct in any number of configurations. The air jacket could cover the entire axial length of the duct or just cover parts of the axial length of the duct. Similarly, the air jacket could cover the entire outer peripheral length of the duct from a radial standpoint (a cylindrical duct) or cover just a portion of the periphery. For example, for a rectangular duct, only two sides could be covered by the air jacket. For a cylindrical duct, the air jacket could cover just one half of the circumference. A preferred embodiment would be for the air jacket to cover the entirety of the channel formed by the duct having the air pass through it, which would mean surrounding the duct and covering its entire length and this would provide maximum insulation.

The membrane or membranes used to form the air jacket must be adequately sealed on ends thereof and at the opening or openings existing to receive the pressurizing air. The seals must be sufficient to sustain the static pressure in the air space of the air jacket as a result of the air source, e.g., the air handler blower. In a preferred embodiment, the air jacket would be formed on the duct inner wall and, if desired, surrounded by insulation. In this embodiment, the membrane would be applied during the manufacturing process of the duct and would cover the entire outer surface of the duct inner liner. The membrane would extend from one end of the duct to the other end and terminate with the other duct components—including the inner liner. The membrane could also exhibit mechanical properties that allow it to withstand forces applied to it during packaging and handling without rupture. This is particularly applicable to situations where the duct having the membranes is axially compressed.

The membrane could be sealed to the duct or a duct fitting to form the air space capable of being pressurized in any known manner. When using the membrane as part of a flexible duct construction, the membrane can be sealed using standard connecting materials (clamp, strap, duct tape, mastic, etc.) in conjunction with the inner duct liner. This provides an efficient way to create an air-tight seal for the air jacket at the end of the duct. The membrane(s) could be sealed to fittings at each termination of each duct run rather than at each duct in a multiple duct run to create an independent air jacket around each section of duct. When using a plurality of ducts, each with its own air jacket, each independent air jacket could be pressurized using the static pressure in the duct, by a penetration through the corresponding duct inner liner for that section of duct, wherein the penetration would provide direct communication between the air space of the air jacket and the channel of the duct. Alternatively, the penetration in the inner wall of the duct would include a conduit to the air jacket when the air jacket is not adjacent to the inner wall of the duct.

Alternatively, a single and continuous air jacket—covering multiple duct sections as well as fittings—could also be utilized. This would be particularly useful for covering rigid ducts or previously installed flexible ducts. Each independent air jacket, whether it involves multiple duct sections, runs, or a single section require pressurization—either a penetration through the duct inner liner, a conduit connecting the duct inner liner to the air jacket or an external line connecting the pressurized HVAC system (air handler or other location on supply-side of system) to the air jacket.

Controls can be employed so that the jacket pressure is regulated to achieve the desired static condition. The controls can include an orifice that would act as a pressure relief valve if the pressure in the air jacket would become too high, although this is an unlikely condition given the low pressures in the duct. Another control could include providing at the inlet to the air jacket a check valve or the like to maintain pressure. Another control option includes a flow control device—manual or automatic—and/or blower control device to raise or lower system pressure to maintain an optimal jacket pressure and, thereby, optimal thermal resistance.

The following figures provide more detail as to the duct with inflatable air jacket construction, different embodiments and options to be used in conjunction with the invention.

FIG. 1 shows a first embodiment of the invention wherein the inventive duct is designated by reference numeral 10. In this embodiment, the duct has a rigid construction but it can also be flexible in construction. The duct has a duct wall 1, which is surrounded by an air jacket 3. The air jacket 3 is formed by an outer surface 5 of the duct wall 1 and a flexible membrane 7. The duct 10 is shown with a fitting 2 and the air flow direction is shown by arrow A.

The duct wall 1 has an opening 9, which provides communication between a channel 11 formed by the duct wall 1 and an air space 13 within the air jacket 3. Air passing through the channel 11 enters the air space 13 via the opening 9 to inflate the air jacket 3. The opening 9 is sized so that the static pressure in the channel 11 is generally the same as that in the air space 13. The flow of air into the air space 13 should be such that it creates a static pressure, i.e., no or minimal current conditions so that maximum insulating properties for the duct exist. Creating air currents in the air space 13 defeats the insulating effect of the air jacket 3. While a single opening 9 is preferred to minimize air currents, multiple openings could be employed as long as their locations are such that air currents would not be created. For example, two or more openings could be provided, with each opening located along the duct axis at the same point and diametrically opposed to each other (two openings) or radially spaced apart for two or more openings.

The ends of the membrane, one at 15 shown in FIG. 1 are secured to the outer surface 5 of the duct wall 1 in any known manner using a fastening mechanism or means, e.g., adhesive, tape, straps, clamping, or a combination thereof. Sealing of the ends 15 of the membrane permit the inflation and pressurizing of the air space 13 to provide the insulating effect of the air jacket 3 on the duct 10. The sealing could also be done using a duct fitting located at an end of the duct and one that would be attached to a duct.

The inflation/pressurization of the air space 13 using the air passing through the channel/static pressure in the duct means that no other source of air is needed to inflate/pressurize the air jacket 3 and the air jacket is inflated/pressurized only during times that air is passing through the channel 11 so that the conditioned air flowing through the duct 10 is insulated. In this mode, additional lines and connections to a static pressure source like that of an HVAC system air handler blower is avoided, thus providing a simple way to add insulating value to the duct.

The air jacket 3 can also include a low emissivity material (low-E material) 17 on the duct outer surface 5, an inner surface 19 of the membrane 7, or both surfaces to enhance the insulating effect of the air jacket 3. These low-E materials 17 are known in the art and include metal foils or films coated with a metallic material. Some of these materials are made as a laminate construction with a polymer film such as polyester, and thin aluminum coating on a surface of the polyester. The metal film side can be used to insulate against radiant heating effects. The materials can be applied to either or both surfaces within the air space using conventional attaching techniques such as adhesives and the like.

As an example of use in the FIG. 1 embodiment, the low-E material 17 could be applied to the exterior of the outer surface 5 of the duct wall 1 with the metal coating facing the air space 13 of the air jacket 3. Alternatively, to minimize corrosion effects to the metallic coating when using a metallic-coated polymer film, the polymer film of the laminate low-E material 17 faces the air space 13 and the exposed metal film faces the duct wall 1. In this way, the metallic film is covered by the clear polymer film and protected from the environment of the air space 13. While this does not provide the same insulating/radiant effect as if the exposed metallic film faces the air space 13, it still provides an insulating value while at the same time minimizing corrosion to the metal film. More particularly, concerning the metalized polyester film, when the metal film side is facing the air space 13, the emissivity value will be around 0.05, whereas when the polymer side faces the air space 13 the emissivity value is around 0.45. While the latter configuration does not provide as high a radiant effect, this latter configuration still provides an R value of around 1 for insulation purposes. This configuration is called an R-1 configuration for this particularly oriented low-E material.

The air jacket 3 can generally provide an R1 insulating value to the duct 10. When using a low emissivity material 17 in the R1 configuration in combination with the air jacket 3, a R2 value can be added to the duct 10. This becomes a significant factor since a duct with insulation that has an R6 value can be transformed into a duct with an R8 value by just adding the air jacket 3 and the low-E material 17 in the R1 configuration. Providing this additional R2 is a lower cost option than increasing the insulating value of the duct from R6 to R8 by using additional insulation. The incremental step of R2 also allows commercially available duct insulation to be used without incurring added costs of having to utilize a custom insulation material.

The addition of an R2 value for the duct is also significant in the HVAC industry since duct insulation is rated by code in terms of R4.2, R6.0, and R8.0 ductwork and these are typically available types of insulated ducts or duct insulation for use in HVAC applications. There are no typical ductwork applications using R7.0 values. Thus, providing a system that adds only an R1.0 value, while being useful in applications that would not be constrained by HVAC industry standards, would not be useful in an HVAC application that requires either R6.0 or R8.0 ductwork. Improving an R6.0 duct to an R7.0 duct does not produce a duct that can be used in an application that mandates R8 values.

Figure 2:
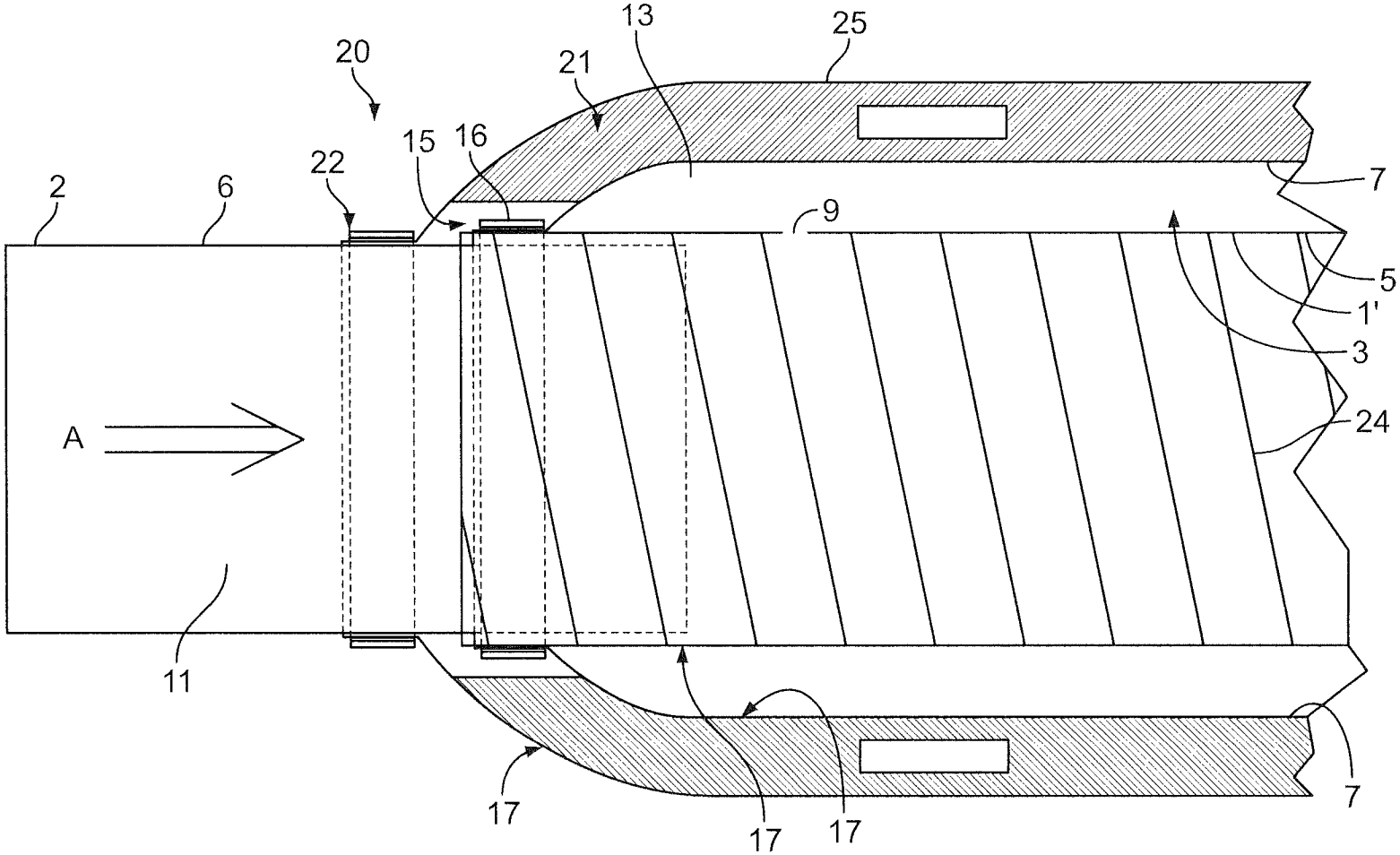
FIG. 2 is a schematic view of a second embodiment of the insulating duct of the invention.

FIG. 2 shows a second embodiment of the invention, wherein the air jacket 3 is used in combination with an insulating layer 21 to produce a duct 20. In this embodiment, the air jacket 3 is adjacent the duct outer surface 5 and the insulating layer 21 surrounds the membrane 7. The insulating layer 21 can be made of any insulating material known for use with ducts, but is generally a fiberglass.

The air jacket 3 in FIG. 2 is secured to the outer surface 5 of the duct wall 1 in the same manner as described for FIG. 1, wherein end 15 uses fastening mechanism/means 16 for sealing. The insulating layer 21 is also secured to the outer surface 6 of the fitting 2 in a similar manner using clamps, tape, straps, and the like, either alone or in combination as the fastening mechanism/means 22. While the insulation layer 21 is shown secured to the fitting 2, it can be attached to the duct wall 1, if desired.

The insulating layer 21 can be surrounded with another layer 25, which could be a vapor barrier as is commonly found in ductwork or any other layer typically used to cover the outer surface of insulation on a duct.

For FIG. 2, the duct wall 1' is shown as a flexible duct construction but can be either rigid or flexible. If flexible, the duct wall can be a conventional type wall, which includes a helical support structure 24 sandwiched between two polymer film layers, e.g., polyester. However, any known flexible duct wall construction can be used in combination with the air jacket 3.

The FIG. 2 embodiment can also employ the low emissivity material 17 on the outer surface 5 of the duct 20 or the inside of the membrane 7, or both.

The inflation of the air jacket 3 is done in the same way for FIG. 2 as that described for FIG. 1. The only difference is that the inflation of the air jacket 3 moves the insulating layer 21 when air is flowing through the duct 20.

Figure 3:
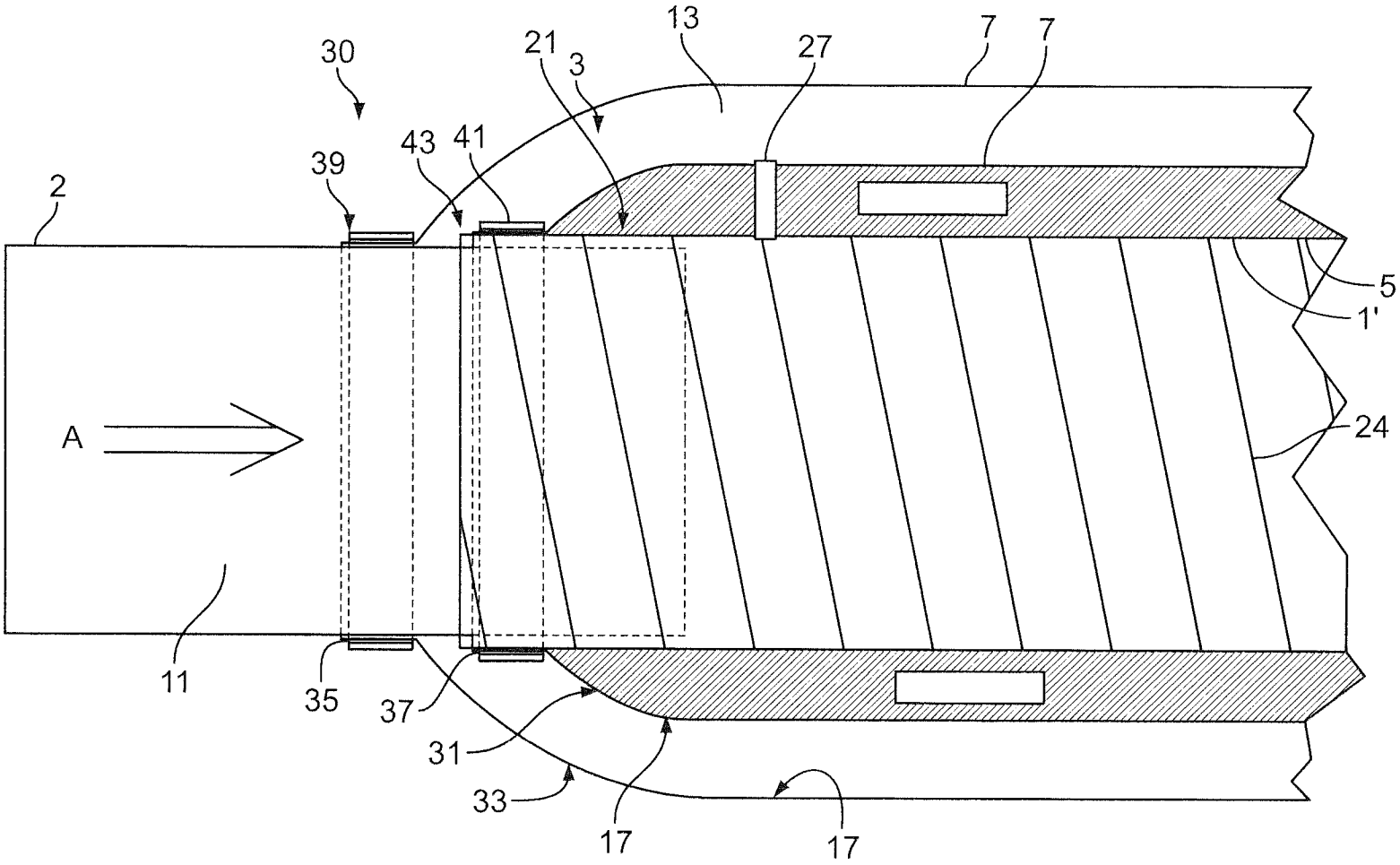
FIG. 3 is a schematic view of a third embodiment of the insulating duct of the invention.

FIG. 3 shows a variation on the FIG. 2 embodiment, wherein the insulating layer 21 is adjacent to the outer surface 5 of a duct 30 and the air jacket 3 surrounds the insulating layer 21. Because of this configuration, the air jacket 3 requires two membranes 7 since it does not use the outer surface 5 of the duct to form the air jacket 3, as in FIGS. 1 and 2.

Since the insulation is positioned between the air jacket 3 and the duct wall 1, a conduit 27 is provided that provides communication between the channel 11 and the air space 13. The conduit 27 can be secured to the membrane 7 of the air jacket 3 and duct wall 1 in any way such that the air passing through the channel 11 passes through the conduit 27 to create the static pressure condition in the air space 13. The conduit 27 could be applied in such manner as to prevent inflation of the duct cavity containing the insulation layer 21.

As with the FIGS. 1 and 2 embodiments, one or both of the inner surfaces 31 and 33 of the membranes 7 can include the low-E material 17 to provide additional insulating value to the duct 30. Also, the ends of the membrane 35 and 37 would be sealed to the duct outer surface 5 in the same manner as shown in FIGS. 1 and 2. Since two membranes 7 are used, two fastening mechanisms or means 39 and 41 are employed. If desired, the end 43 of the insulation could utilize the fastening mechanism 41 as well.

Figure 4:
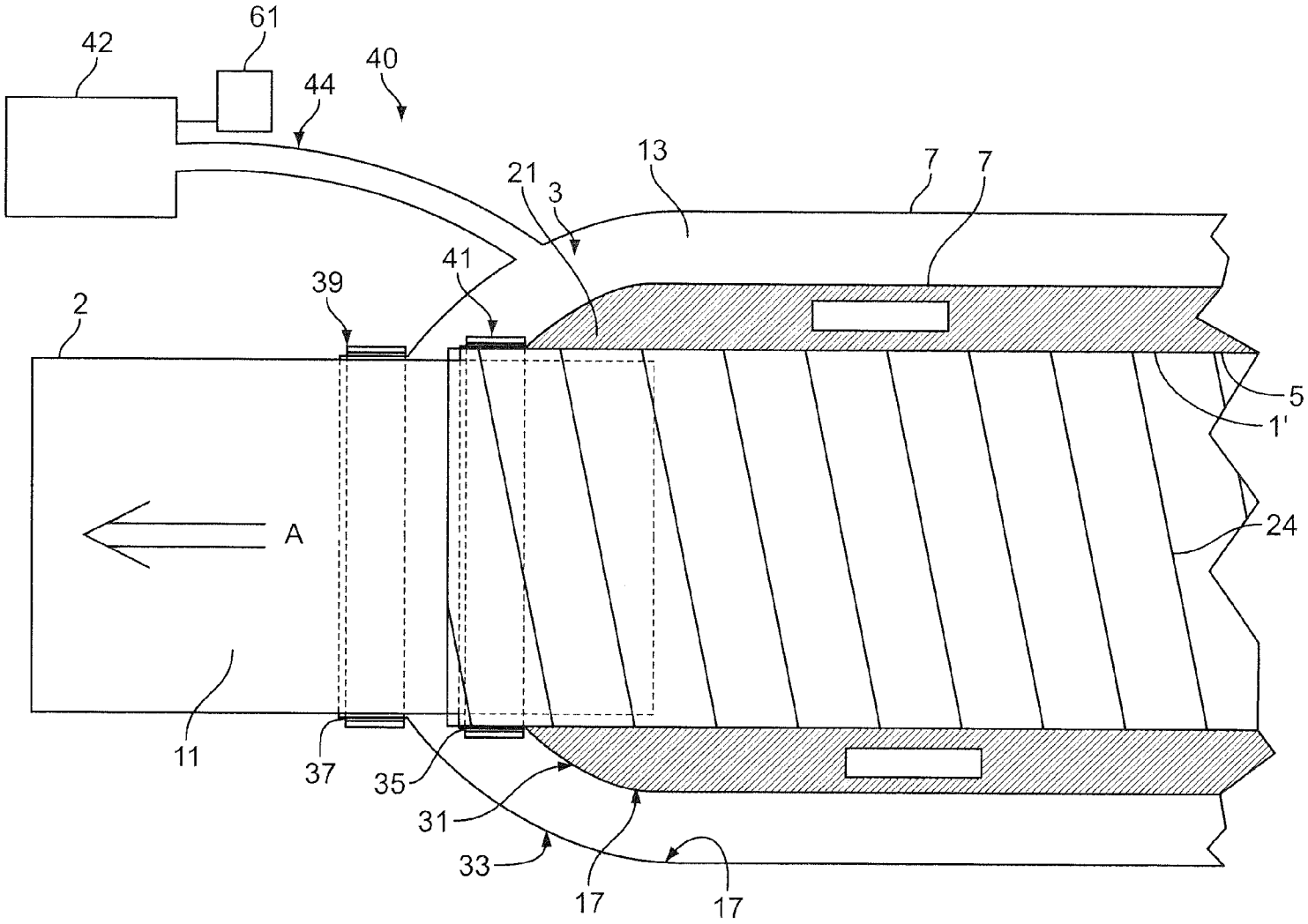
FIG. 4 is a schematic view of a fourth embodiment of the insulating duct of the invention.
Figure 5:
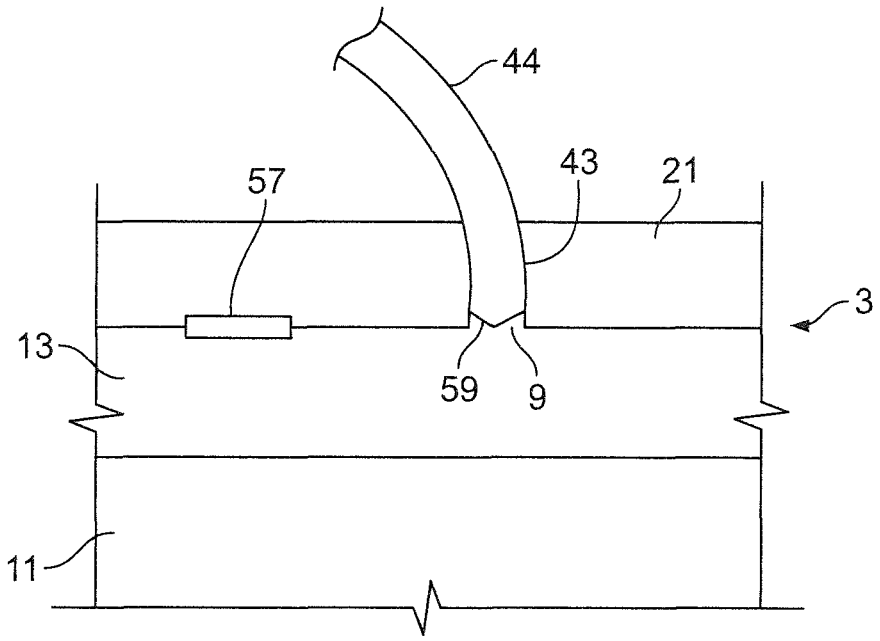
FIG. 5 shows a partial schematic view of an embodiment combining features of FIGS. 3 and 4.

FIG. 4 shows a variation of FIGS. 1-3. In this embodiment, the air/static pressure for inflating/pressurizing the air jacket 3 is supplied by a source of air 42 other than that passing through the duct 40. This source 42 could be the same air handler that supplies air to the duct 40, but it could be a separate source of air/static pressure as well. The air in this embodiment is supplied to the air jacket 3 by line 44. All of the other features described for FIGS. 1-3 would be applicable to the FIG. 4 configuration While FIG. 4 shows the embodiment where the air jacket 3 is on the outside of the insulation layer 21, the FIG. 3 embodiment could also be employed with a source of air other than that flowing through the duct. This configuration is shown in FIG. 5, wherein the insulating layer 21 surrounds the air jacket 3 and a conduit 43 extends through the insulating layer 21 to provide the air/static pressure condition from line 44 to the air space 13.

Figure 6:
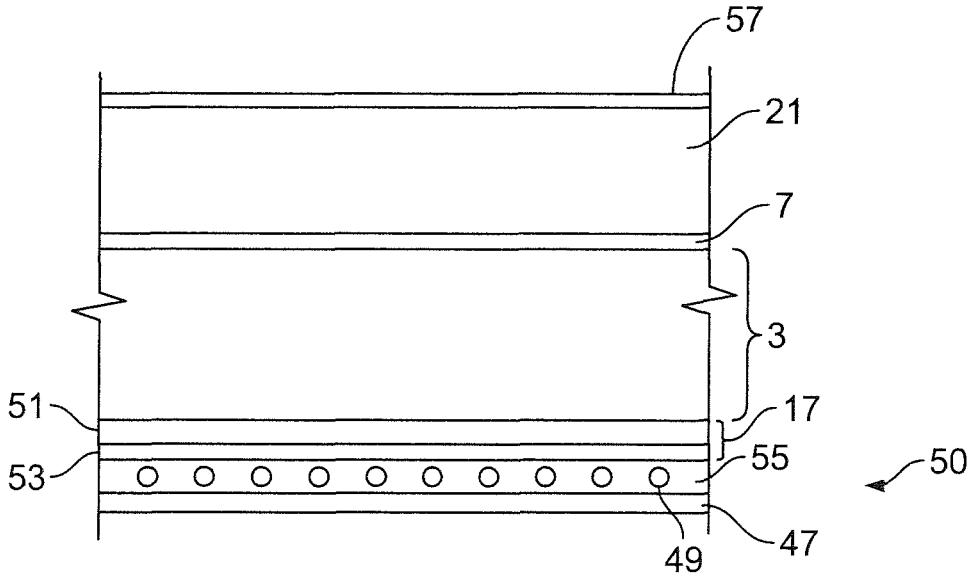
FIG. 6 shows one type of low emissivity material for use with the inventive duct.

FIG. 6 shows a preferred embodiment of the invention, wherein the air jacket 3 and the insulating layer 21 are combined with a flexible duct wall construction 50. Starting from the inside of the duct 50, the duct wall construction includes a polymer film 47, a helical support structure 49, and the low-E film 17. The low-E film 17 is made up of a polymer film 51 and metallic coating 53. The low-E film 17 is glued to the helical support structure 49 and film 47 using the adhesive 55 to form the duct wall 50, which forms one wall of the air jacket 3. The other wall of the air jacket 3 is a membrane 7, which can be any type described above, including one that has a low-E material 17. The insulating layer 21 surrounds the air jacket 3 and a vapor barrier 57 can be use to surround the insulating layer. The vapor barrier 57 can include a scrim for tear resistance.

The air jacket 3 can employ a pressure relief valve to relieve pressure in the air jacket 3 if it should rise above a certain level. The pressure relief valve can be located in any convenient location and is shown schematically in FIG. 5 as 57. The air jacket could also include a check valve to regulate the direction of air flow into the air space 13. This check valve is shown schematically in FIG. 5 as 59. A controller 61 can also be used in connection with the separate line 44 and air handler 42 shown in FIG. 4.

The membrane for the air jacket 3 can be any material that will enable the air jacket 3 to inflate when air is directed between its walls. For the FIG. 1-3 embodiments, only one membrane is needed as the duct wall 1 forms the other wall of the air jacket 3. In FIG. 4, a pair of membranes 7 are needed to form the inflatable air jacket 3. When two membranes are used, they could be the same or different and one membrane or both membranes could be or include a low-E film 17.

Thermal testing shows that the thermal resistance of a system including a radiant or low-E material looking (facing the air space of the air jacket) into the air jacket improves with increasing jacket thickness. Duct wall sections with air jacket thicknesses of 0.25", 0.5" and 0.75" were tested with the radiant or low-E film looking into the air jacket. The 0.75" jacket thickness allowed for the best thermal resistance overall. However, the optimal jacket thickness is around 0.5"—giving the required incremental thermal resistance needed while limiting convection currents and minimizing cost and overall duct diameter. While the 0.25" air jacket thickness does provide an insulating value and can be used in certain application, this thickness did not provide enough improvement in thermal resistance to achieve a jump from one acceptable level of R-value to the next one, e.g., R-6 to R-8.

Duct systems are normally designed to minimize friction loss and operate at the lowest possible static pressure. Well-designed supply duct systems in residential HVAC systems operate at static pressures of around 0.08" to 0.1" $H_2O$ column. Laboratory tests on 6" flexible ducts employing the invention have shown that static pressures within this range adequately inflate the air jacket. Even lower static pressures (0.05" $H_2O$ column) have shown marginally good inflation. Many residential systems operate above 0.1" $H_2O$. Supply-side duct static pressures of up to 0.25" are fairly typical. This testing demonstrates that the inventive air-jacket containing duct can function using the air flowing through the duct for air jacket inflation and thus proves the advantage of the invention, which is providing an efficient and cost effective way to add additional R-value to a duct.

As noted above, one or more air jackets can be used with just a duct. One or more air jackets could be used in combination with other insulating layers in any order. One or more low emissivity films can be used as part of the duct, with a preference for the low emissivity surfaces to comprise one or both of the inner walls of the air space within the jacket and the outer air jacket film so as to increase thermal resistance or minimize energy losses from the duct.

As such, an invention has been disclosed in terms of preferred embodiments thereof which fulfills each and every one of the objects of the present invention as set forth above and provides a new and improved insulated duct and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A flexible insulated duct comprising:

a duct segment having a duct wall, an axial length, and a peripheral length that forms a channel for fluid to flow therethrough;

an inflatable jacket surrounding at least a portion of the axial and peripheral lengths of the duct wall, the inflatable jacket comprising at least one flexible membrane, opposite ends of the at least one flexible membrane sealed to the duct segment;

for at least the portion of the axial and peripheral lengths of the duct wall surrounded by the inflatable jacket, the inflatable jacket includes a space formed by the opposite ends of the at least one flexible membrane being sealed to the duct segment, the duct wall having one of the following to provide communication between the space and the channel;

i) a single opening in the duct wall; or ii) a pair of openings, the pair of openings diametrically opposed to each other in the duct wall; or iii) a plurality of openings, each of the plurality of openings radially spaced apart in the duct wall and on a plane perpendicular to an axis of the duct;

wherein the at least one flexible membrane expands to create an enlarged space as a result of pressurization by the fluid from the channel entering the space through the single opening, or the pair of openings, or the plurality of openings in the duct wall, the enlarged space consisting of the fluid, and by opposite ends of the at least one flexible membrane being sealed to the duct segment and one of the single opening, the pair of openings, and the plurality of openings being in the duct wall, the enlarged space has a static fluid flow condition at steady-state fluid flow conditions in the channel.

2. The flexible insulated duct of claim 1, wherein the duct segment includes an insulating layer disposed between the inflatable jacket and the duct wall and the at least one opening extends through the insulation layer to provide communication between the channel and the empty inflatable space.

3. The flexible insulated duct of claim 2, further comprising a pair of membranes, a first membrane adjacent an outer surface of the insulation layer and a second membrane forming an outer layer of the duct segment.

4. The flexible insulated duct of claim 1, wherein the duct segment includes an insulation layer disposed on the outside of the membrane.

5. The flexible insulated duct of claim 1, wherein the inflatable jacket includes at least one or opposing low emissivity materials to provide increased thermal resistance.

6. The flexible The insulated duct of claim 1, wherein the inflatable jacket includes a pressure relief valve.

7. The insulated duct of claim 1, wherein each of (i) to (iii) includes a check valve.

8. The flexible insulated duct of claim 1, wherein the opposite ends of the inflatable jacket are sealed to the duct segment using one or more of clamps, tape, or adhesive or a combination thereof.

9. The flexible insulated duct of claim 1, further comprising a plurality of duct segments in combination with one inflatable jacket and the at least one opening is in communication with one of the duct segments.

10. The flexible insulated duct of claim 1, further comprising a plurality of duct segments with one inflatable jacket for each of the plurality of duct segments.

11. The flexible insulated duct of claim 1, wherein a thickness of the inflatable space ranges between about 0.25 to 0.75 inches.

12. The insulated duct of claim 1, wherein the duct segment contains a helical support member as part of the duct wall.

13. In a method of providing conditioned air through an insulated duct segment in a duct system, the improvement comprising using the flexible insulated duct of claim 1 in the duct system.

14. A flexible insulated duct sized for HVAC use comprising a duct segment, having a duct wall, an axial length, and a peripheral length that forms a channel for fluid to flow therethrough;

an inflatable jacket surrounding at least a portion of the axial and peripheral lengths of the duct wall, the inflatable jacket comprising at least one flexible membrane, opposite ends of the at least one membrane sealed to the duct segment, for at least the portion of the axial and peripheral lengths of the duct segment surrounded by the inflatable jacket, the inflatable jacket includes a space formed by opposite ends of the at least one flexible membrane sealed to the duct segment, the duct wall having one of the following to provide communication between the space and the channel;

i) a single opening in the duct wall; or ii) a pair of openings, the pair of openings diametrically opposed to each other in the duct wall; or iii) a plurality of openings, each of the plurality of openings radially spaced apart in the duct wall and on a plane perpendicular to an axis of the duct;

a low emissivity material located on at least one inner surface forming the space of the inflatable jacket, wherein the at least one flexible membrane expands to create an enlarged space as a result of pressurization by the fluid from the channel, the enlarged space consisting of the fluid, and by the opposite ends of the at least one flexible membrane being sealed to the duct segment and one of the single opening, the pair of openings, and the plurality of openings being in the duct wall, the enlarged space has a static fluid flow condition at steady-state fluid flow conditions in the channel.

15. The flexible insulated duct of claim 14, further comprising an insulating layer surrounding the inflatable jacket or positioned between the inflatable jacket and the duct wall, wherein the inflatable jacket includes two membranes when the inflatable jacket is disposed on the outside of the insulating layer.

* * * * *